United States Patent [19]

Watson

[11] Patent Number: 4,580,880

[45] Date of Patent: Apr. 8, 1986

[54] NON-REVERSING MIRROR DEVICE WITH PERCEIVED DEPTH PERSPECTIVE

[76] Inventor: William Watson, 174 W. 76th St., New York, N.Y. 10018

[21] Appl. No.: 581,526

[22] Filed: Feb. 21, 1984

[51] Int. Cl.[4] ..... G02B 5/08

[52] U.S. Cl. ..... 350/621; 350/617; 350/631

[58] Field of Search ..... 350/616, 617, 621, 612, 350/615, 600, 631, 276 R, 276 SL, 277; 362/135, 140; 272/8 M

[56] References Cited

U.S. PATENT DOCUMENTS

| | | | |
|---|---|---|---|
| 370,623 | 9/1887 | Hooker | 350/617 |
| 533,167 | 1/1895 | Fuller | 350/627 |
| 813,136 | 2/1906 | Balch | 350/617 |
| 1,991,054 | 2/1935 | Hampke | 350/618 |
| 3,022,709 | 2/1962 | Duggan | 350/617 |
| 3,151,207 | 9/1964 | Moller | 350/627 |
| 4,050,790 | 9/1977 | Jorwa | 350/617 |
| 4,235,524 | 11/1980 | Lechter et al. | 350/616 |

FOREIGN PATENT DOCUMENTS

| | | | |
|---|---|---|---|
| 588765 | 5/1925 | France | 350/615 |

*Primary Examiner*—Jon W. Henry

*Attorney, Agent, or Firm*—Lieberman, Rudolph & Nowak

[57] ABSTRACT

The instant invention is an optical mirror device intended primarily as a make-up mirror for applying cosmetics. The mirror device permits the user to view herself in two images simultaneously, both as a standard mirror image with left and right reversed and as a true non-reversed image such as is perceived by others. The observer perceives each image as being a single rectangular viewing surface, with a more three-dimensional appearance than with a normal plane mirror. The mirror device is preferably used with its own source of lighting and with the mirrors enclosed in a darkened chamber so as to give true color reproduction without false coloration from ambient light.

3 Claims, 6 Drawing Figures

NON-REVERSING MIRROR DEVICE WITH PERCEIVED DEPTH PERSPECTIVE

BACKGROUND OF THE INVENTION

1. Field of the Invention

The instant invention is an optical device primarily for use as a make-up mirror in applying cosmetics. The mirror device permits the user to view herself (or himself) in two images simultaneously, both as a standard mirror image with left and right reversed and as a true non-reversed image such as is perceived by others. Further, the mirror device creates a three dimensional effect and permits removal of ambient light color balance distortions, so as to create images of the viewer more useful and vivid than before.

2. Description of the Prior Art

It has been said that man's obsession with looking at his image in a mirror is not really so much from desire to see what he looks like, but rather how he appears to others.

Indeed, the entire field of cosmetics for both men and women is based on products, technology and methods of application that will alter or improve the way that others see us. To preview this, the most commonly used device for perceiving how we appear to others is the single plane mirror. While people normally assume that what they see in the single plane mirror is an acurate representation of how they look to others, this is not so. First, the standard plane mirror presents a reversed image. Second, a plane mirror flattens the image, losing an important sense of three-dimensionality, because the traditional mirror does not provide the eyes with true-to-life depth of field. Third, the usual plane mirror will distort the color of both skin and applied cosmetics because the mirror will reflect not only the image but also all the direct and indirect lighting and color tones present in the room.

It is well known that two plane mirrors placed at right angles to each other will provide a "true" non-reversed image. See U.S. Pat. No. 370,623 of September 1887 to Hooker. But there are two basic problems caused by this design. First, it is disconcerting to view an image on two converging planes rather than on a single, flat field, and second, it is difficult to apply make-up because eye to hand motor coordination is accustomed to dealing with the reversals of a plane mirror.

It is also well known in the art to combine a plane mirror with lighting devices having different color balance which purport to create various effect, such as office lighting, candle light or day light, etc. But these products are believed not to be fully successful because their lighting effect is distorted by external lighting sources and by the special lights of the mirror going both to the face and to the mirror rather than only to the face.

SUMMARY OF THE INVENTION

These and other difficulties in the prior art are overcome by the instant invention of a mirror device primarily for the use in the application of cosmetic products and procedures which makes it possible for the observer to view herself simultaneously in both a standard plane mirror with a reversed image and in a "true" mirror with a non-reversed image.

The observer perceives each image as being on a single rectangular viewing surface. The reflection appears more three-dimensional than in the prior art and has true color reproduction. Both views of the user's face can be seen simultaneously with only a slight movement of the eyes.

One image, referred to for convenience as the bottom image, is the standard reversed view which gives the user a familiar frame of reference for eye-hand coordination as is necessary to conveniently apply cosmetic products and procedures. The other, upper image, is a true non-reversed view of how other people see the user, providing corrective information about how she really looks. The actual adjustments and changes are then done with reference to the lower mirror which provides for easier eye-hand coordination.

Although the instant device can be constructed with three mirrors at particular distances and angles, the user perceives none of this, instead seeing only two rectangular images of the same size and shape, one above the other. As it will be seen from the detailed description below, the perceived borders and images are really quite different from the actual borders and construction of the mirror device; the combination of mirrors and borders at certain angels and distances combine to create the unique perceptual effects which are one of the main goals of the mirror device.

It is intended that the mirror device be used with its own lighting sources, which in the preferred embodiment illustrated are along with left and right vertical borders of the device, rather than using ambient light. The three-dimensional effect is much greater when the mirror device is used in a darkened room with its own lighting. Also, when this is done, the reflected image comes back to the viewed by passing through the purity of the black void of the enclosure. The vertical side panels block any remaining ambient light. No external light sources or reflective colors leak into the image as it is being transmitted to the observer. There is also no peripheral spillage from the device's own lighting as this is screened and directed so as to go only to the user's face, and not permitted to reach the mirror directly. However, even if the observer's face is illuminated by natural light, the mirror device will still work effectively.

DESCRIPTION OF THE PREFERRED EMBODIMENT

Figure 1:
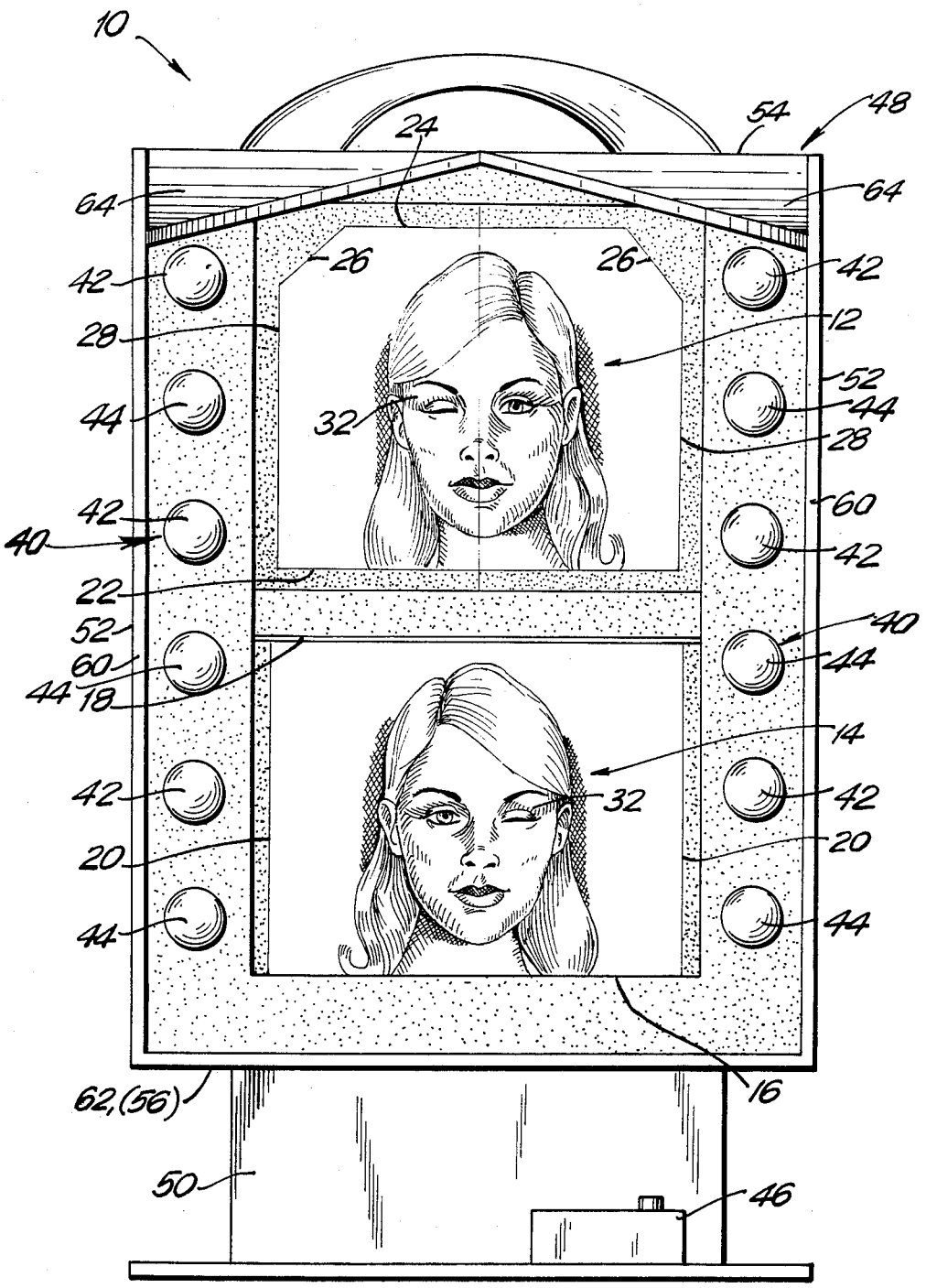
FIG. 1 is a front view of the mirror device showing the reflection of a user in a lower, normal mirror view and an upper non-reversed view.

In accordance with the instant invention, there is supplied a mirror device 10 which produces a first image 12 and a second image 14. In the preferred embodiment, the first image 12 is the top image and the second image 14 is the bottom image.

Further, the top image is a true or non-reversed image while the bottom image is a normal reflection as will be produced by a plane mirror. However, the images could be side to side or arranged differently so long as they were arranged in such a manner as to allow for simultaneous or near simultaneous viewing.

The perspective illusions are created and defined by various borders which are produced by the elements of the physical construction of the mirror device. For convenient reference, the illusion or image and its borders will be described as well as the physical construction which produces the image illusion and borders. Thus, for the lower image, there is a lower or botton border 16, upper border 18 and side borders 20. With respect to the upper image, there are similarly a lower or botton 22, a top border 24 and side borders 28. The top borders of the upper image include angled portions 26 in the preferred embodiment, which, as will be seen below, contribute and add to the three-dimensional effects of the mirror device.

The above-referenced borders are seen to appear on or through a viewing screen 30, which in fact forms one side of the enclosure of the mirror device 10.

It will be noticed that within the viewing screen 30, the top and bottom images are substantially the same in size, placement and framing except that the user's right eye 32 has been closed to demonstrate the difference between the true and normal mirror images.

Figure 6:
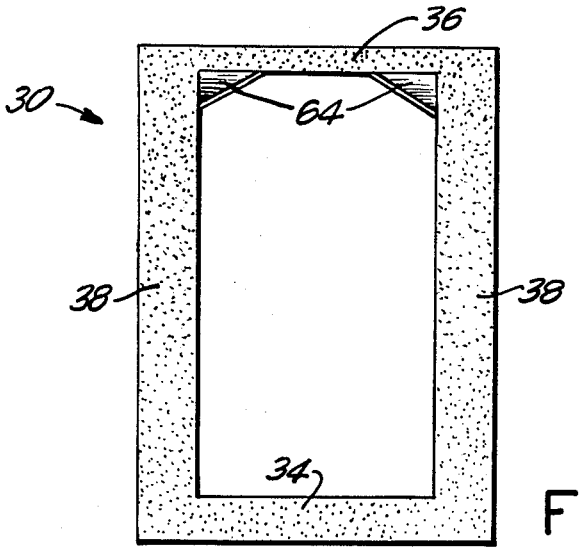

The viewing screen 30 is bordered around its parameter, both on the outside, facing the viewer and on the inside, facing the mirrors. Specifically, with reference to FIGS. 2, 3 and 6, there is supplied an outer felt border along the bottom 34, along the top 36 and along the sides 38 as well as inner borders 34A, 36A and 38A. The outer borders serve to shield the illumination of lights 40 and ambient light from entering into the inside of the mirror device. The inner borders 34A, 36A and 38A serve to create by their reflection the image borders, as will be described in detail below.

There is supplied in the mirror device 10 lights 40 which optionally can include a first group of lights 42 and a second group of lights 44 each balanced to provide a different sort of lighting such as indoor and outdoor, or fluorescent and tungsten, so as to allow the user to perceive her image as it would appear in different intended environments. Lights 40 are controlled by dimmer switch 46 which allows different levels of illumination so as to simulate the various intended environments of use. If two banks of lights are used, dimmer switch 46 could include a center off position between a left on position to increasingly illuminate one bank of lights and a right on position to increasingly illuminate a second bank of lights.

Figure 2:
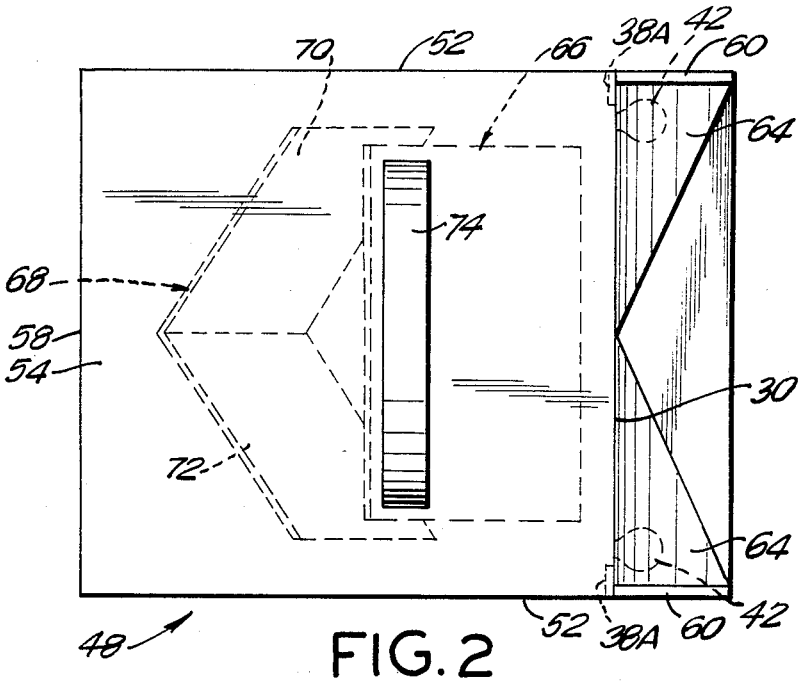
FIG. 2 is a top cut-away view of the mirror device.
Figure 3:
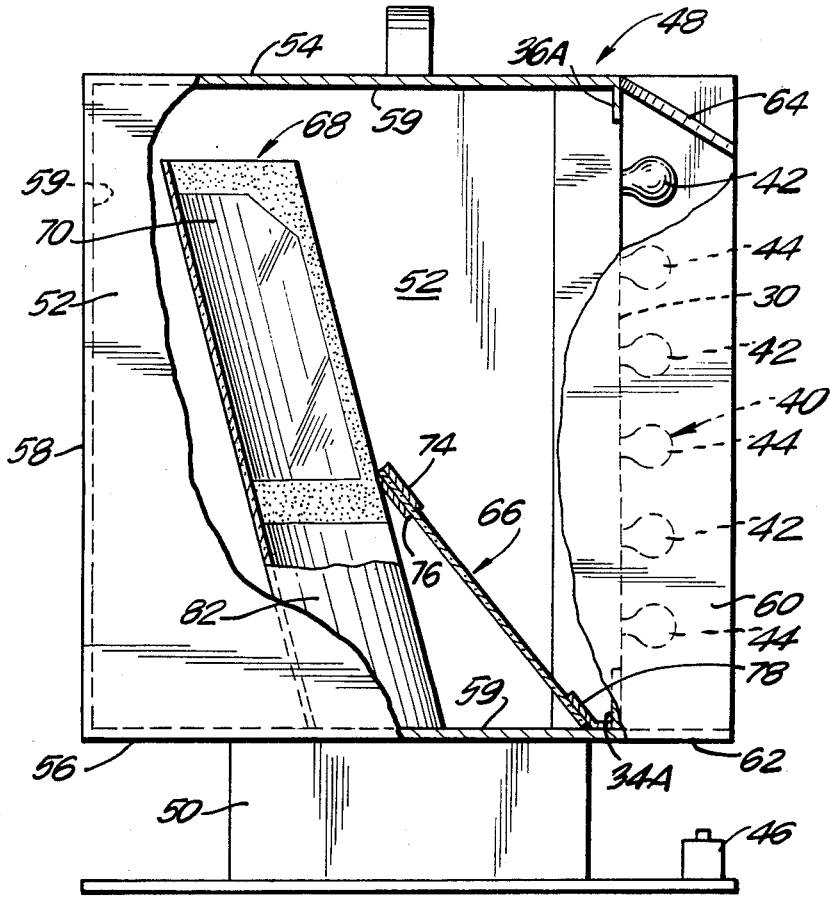
FIG. 3 is a side cut-away view of the mirror device.
Figure 4:
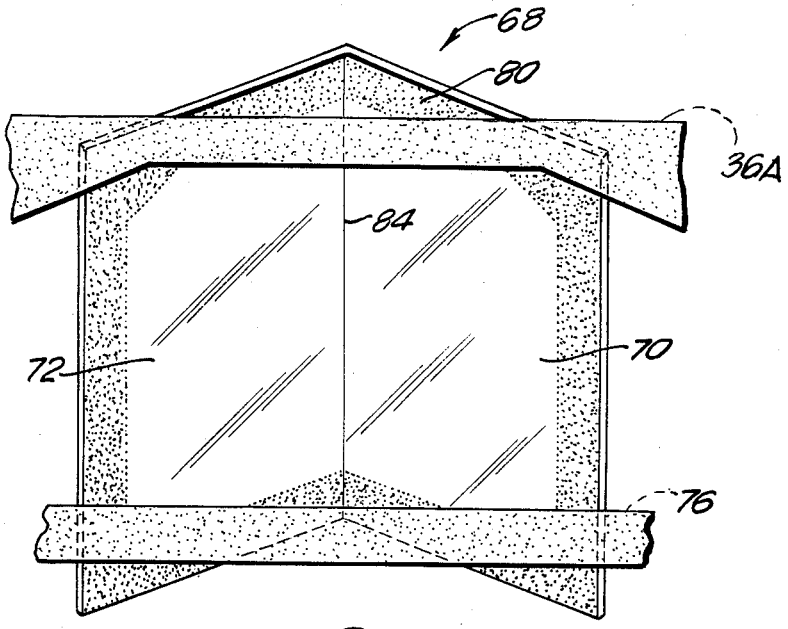
FIGS. 4, 5 and 6 represent the top mirror, the lower mirror and the front viewing screen in isolation from the rest of the mirror device.
Figure 5:
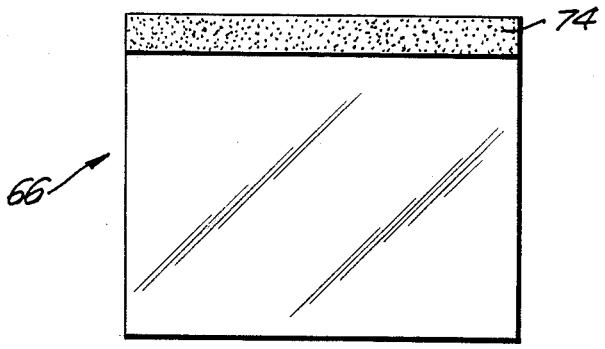

As shown in FIGS. 2 and 3, mirror device 10 is generally enclosed in a housing 48 resting on the base 50. Housing 48 comprises sides 52, top 54 and bottom 56, and rear 58. The interior of the housing, sides, top, bottom and rear are covered with a light absorbing material 59, such as black felt, to eliminate or substantially reduce interior reflection and the like which would otherwise degrade the quality of the image. The front of the housing is supplied by the viewing screen 30.

The sides 52 of the housing are extended to form side flanges 60 while the bottom is extended to form a bottom flange 62 and the top extended and shaped so as to form a top drop flanges 64. These extended flange pieces serve to block the ambient illumination so as to heighten and increase the three-dimensional illusion created by the mirror device and so as to minimize false color and stray lighting which would be caused by ambient illumination. Further, top drop flanges 64 serve in reflection to form the angled portion 26 of the top border of the upper image which further creates a three-dimensional and framing effect in that mirror.

Within the mirror device 10 are included a first mirror unit 66 and a second mirror unit 68. In the preferred embodiment illustrated, second mirror unit 68 is itself comprised of two mirrors 70 and 72. Alternatively, the second mirror unit forming the top image could be comprised of a single mirror formed onto a right angle or orthogonal support piece so as to give the unreversed or true image.

In order to form the illusion of two rectangles hanging in space, the mirror units are edged or bordered with black felt or similar non-reflecting light absorbing material as is now described. At the top of the first mirror, there is a strip of felt supplied both on the front 74 and on the rear 76. There is also a bottom border of felt 78 on the first mirror unit 66. On the second, upper mirror unit 68 there is a felt border 80 which can be optionally supplied to increase the illusion that the top mirror is also a plane, rather than an angled mirror unit, although this border is optional.

The top mirror unit is supported on a base 82, and in the embodiment illustrated, where there are two mirror pieces 70 and 72 comprising the second mirror unit, there is a center line 84 running vertically down the upper mirror unit. It is preferred in the construction of top mirror unit 68 to minimize or eliminate this center line to the extent possible.

The first or lower mirror in the preferred embodiment is set at an angle of approximately 60 degrees from the horizontal, while the upper mirror unit is angled at an inclination somewhat greater, approximately 70 to 75 degrees from the vertical.

The perspective and rectangular illusions are created as follows. The bottom border of the bottom mirror 16 is created by a reflection from the inner bottom felt border 34A on the viewing screen. The side borders on the lower image 20 are created by reflection from the inner felt strips 38A placed on viewing screen 30. The top border of the lower image 18 is created not by reflection, but rather by the actual felt strip at the top of that mirror, to be precise, the lower edge of that felt strip 74.

Because the borders are created by a combination of reflection and a physical blocking, all at different and varying distances, it has been found that a three-dimensional effect has been created in both mirrors.

With respect to the upper or second mirror unit, the lower border 22 is created by a reflection of the upper edge of the inner felt border at the top of the first mirror 76. The side borders 28 on the top image are again created by reflection from the inner felt strips 38A along the sides of the viewing screen. The top border 24 on the upper image is created by a combination of reflection from the inner felt border 36A along the top viewing screen 30, and from the drop flanges 64 angling out from the top 54 of the housing 48. Again, because the borders are created from a variety of reflections at different distances from the mirror, a three-dimensional illusion is created. Further, because the borders created are largely rectangular, they eliminate the user's perception of the V-shape right angled construction of the second mirror unit, allowing the user to perceive the upper image 12 as a simple plane rather than disconcertingly being formed by two right angle mirrors.

Although one embodiment of the instant invention has been described above, numerous variations and changes could be made within the scope of the instant invention. For instance, magnifying mirrors could be used for one or both images. The mirror device could be smaller, foldable or portable. It is not intended by describing the details of one construction to limit the invention in any way.

I claim:

1. A mirror for applying make-up to or viewing a user having a first mirror which shows a normal mirror image of the user, a second and third mirror arranged so as to show an unreversed image of the user, said second and third mirrors being placed above the first mirror, a chamber containing the three mirrors, the interior of which is substantially completely coated with a light absorbing material, lights affixed to the chamber disposed so as to illuminate the user but also disposed so that substantially no direct light enters the chamber, the chamber being constructed so as to create a frame illusion in the first mirror and also so constructed so as to create in cooperation with the placement of the edge of the first mirror a second frame illusion on the second and third mirrors.

2. A mirror in accordance with claim 1 where the images of the first and of the second and third mirrors are substantially similar in size.

3. A mirror for viewing a user having at least a first and second mirror arranged so as to show an unreversed image of the user; and a chamber containing the mirrors, the chamber being constructed so as to create a three dimensional or framing illusion in the mirrors; wherein the interior of the chamber is substantially light absorbing; and lights affixed to the chamber disposed so as to illuminate the user but also so that substantially no direct light enters the chamber.

* * * * *